US012708221B2

(12) United States Patent
Jiang

(10) Patent No.: US 12,708,221 B2
(45) Date of Patent: Aug. 18, 2026

(54) MULTIFUNCTIONAL ENCLOSURE CUSHION

(71) Applicant: Lijun Jiang, Ningbo (CN)

(72) Inventor: Lijun Jiang, Ningbo (CN)

( * ) Notice: Subject to any disclaimer, the term of this patent is extended or adjusted under 35 U.S.C. 154(b) by 511 days.

(21) Appl. No.: 17/988,794

(22) Filed: Nov. 17, 2022

(65) Prior Publication Data

US 2024/0164550 A1 May 23, 2024

(51) Int. Cl.

| | |
|---|---|
| ***A47D 13/06*** | (2006.01) |
| ***A47D 15/00*** | (2006.01) |
| ***A63H 33/00*** | (2006.01) |

(52) U.S. Cl.

CPC ..... *A47D 13/06* (2013.01); *A47D 15/00* (2013.01); *A63H 33/006* (2013.01)

(58) Field of Classification Search

CPC ..... A47D 13/06; A47D 13/063; A47D 15/00; A47D 15/003; A47D 15/001; A63H 33/006; Y10S 5/946; A01K 1/0353; B65D 33/28

See application file for complete search history.

(56) References Cited

U.S. PATENT DOCUMENTS 1,861,864 A * 6/1932 Kennedy ..... B65D 33/28 493/225
5,971,611 A * 10/1999 Rosengren ..... A45C 9/00 383/14
D990,927 S * 7/2023 Zhao ..... D6/596
(Continued)

FOREIGN PATENT DOCUMENTS

KR 20210000787 U * 4/2021 ..... A01K 1/035

OTHER PUBLICATIONS

Multifunctional Enclosure Cushion, 5-in-1 Thick & Plush Play Gym, Convertible Stage-Based Developmental Activity Gym & Play Mat from Baby to Toddler, Ball Pit, Pet Cushion, Balls are not Included, amazon.com, Mar. 9, 2022, https://www.amazon.com/dp/B09S5CJXGS?th=1 (Last accessed: Nov. 17, 2022).

*Primary Examiner* — Matthew Troutman
*Assistant Examiner* — Alison N Labarge
(74) *Attorney, Agent, or Firm* — Jose Cherson Weissbrot

(57) ABSTRACT

A multifunctional enclosure cushion comprises a floor mat, wherein the floor mat comprises an outer edge, a pillow bag is connected to the outer edge, and the pillow bag has a parabola-shaped cross section and comprises two peripheral end points; and an envelope, wherein the envelope is provided with an outer edge, an inner edge and a central axis, wherein the inner edge is connected with the outer edge of the floor mat, the pillow bag is formed with a concave shape at the position of the central axis, and two wire harnesses are respectively fixed to the two peripheral end points; the two wire harnesses extend oppositely along the outer edge of the envelope and meet at the central axis to form a pull ring; when the pull ring is pulled, the two wire harnesses drive the two peripheral end points of the pillow bag to gather in the direction of the central axis, and at this time, the pillow bag turns up along the outer edge of the floor mat to form an enclosure. The enclosure cushion which forms the enclosure state can prevent the babies in the enclosure cushion from climbing out of the floor mat to cause danger, and at the same time, the enclosure cushion also has a variety of functions such as backrest, pillow, baby cradle, floor mat, etc.

6 Claims, 10 Drawing Sheets

(56) References Cited

U.S. PATENT DOCUMENTS

| | | | | |
|---|---|---|---|---|
| 11,737,425 | B1 * | 8/2023 | Vaillancourt | A01K 15/026<br>119/702 |
| 2005/0224000 | A1 * | 10/2005 | Holte | A01K 1/0353<br>119/28.5 |
| 2009/0253342 | A1 * | 10/2009 | Oren | A47D 15/003<br>5/655 |
| 2013/0280983 | A1 * | 10/2013 | Fair | B62B 3/1456<br>446/227 |
| 2015/0157134 | A1 * | 6/2015 | Ko | A47G 9/1081<br>5/652 |
| 2016/0309913 | A1 * | 10/2016 | Peterson | A47D 15/003 |
| 2017/0252662 | A1 * | 9/2017 | Elson | A47D 15/003 |
| 2019/0099685 | A1 * | 4/2019 | Rolph | A63H 33/006 |
| 2022/0009674 | A1 * | 1/2022 | Schein | B65D 29/02 |

* cited by examiner

MULTIFUNCTIONAL ENCLOSURE CUSHION

TECHNICAL FIELD

The present application relates to a multifunctional enclosure cushion.

BACKGROUND

An enclosure refers to the use of enclosures or other items to physically isolate people or things within a certain space to protect people or things inside the enclosure. The floor mat is to lay a layer of flexible material on the hard ground, and set a buffer layer between the hard bottom and people, so that when people fall, their bodies will not directly collide with the hard ground and cause injuries. In the prior art, some people also combine the enclosure with the floor mat to make the enclosure cushion, so that people or things in the enclosure cushion have the greatest safety guarantee.

However, in the prior art, the enclosure cushion is mainly used to prevent the baby from climbing out of the floor mat to cause danger. This type of enclosure cushion product has a single function, and the baby can only crawl, roll or sleep in the enclosure cushion, but there is no other fun. In addition, when the baby grows up, the enclosure cushion loses its function.

SUMMARY

In view of the shortcomings of the above problems, the present application provides a multifunctional enclosure cushion.

In order to achieve the above purpose, the present application provides a multifunctional enclosure cushion, which includes a floor mat, wherein the floor mat comprises an outer edge, the outer edge is connected with a pillow bag, and the pillow bag has a parabolic cross section and comprises peripheral end points; and an envelope, wherein the envelope has an outer edge, an inner edge and a central axis; the inner edge is connected with the outer edge of the floor mat, the pillow bag is formed with a concave shape at the position of the central axis; the peripheral end points are respectively fixed with wire harnesses, and the wire harnesses extend oppositely along the outer edge of the envelope and meet at the central axis to form a pull ring; when the pull ring is pulled, the two wire harnesses drive the peripheral end points of the pillow bag to gather in the direction of the central axis, and at this time, the pillow bag simultaneously turns up along the outer edge of the floor mat to form an enclosure.

As a further improvement of the present application, there are a plurality of pillow bags.

As a further improvement of the present application, the floor mat and the pillow bag are made of flexible cloth, and the inner elastic material is sponge or other elastic materials.

As a further improvement of the present application, the floor mat is connected with the pillow bag by sewing, and the pillow bag is connected with the adjacent pillow bag by sewing.

As a further improvement of the present application, the floor mat is round, and the lateral width of the pillow bag decreases towards the center of the floor mat.

As a further improvement of the present application, the wire harnesses re fixedly connected with the peripheral end points by sewing.

As a further improvement of the present application, the floor mat also includes a toy hanger and a hinge, wherein the toy hanger is made of sponge and bent into an arch shape, and the hinge can be a snap button or a spring button.

As a further improvement of the present application, the toy hanger is movably connected with the floor mat by the hinge.

Compared with the existing enclosure cushion, the present application has the beneficial effects that: by pulling the pull ring, the wire harness drives the two peripheral end points of the pillow bag to gather in the direction of the central axis, and then the pillow bag is driven to turn up along the outer edge of the floor mat to form the enclosure, and the pillow bag formed by the enclosure can limit the danger of babies climbing out of the floor mat, and can also be used as a backrest for babies or a pillow for adults; Reset the enclosure and disassemble the toy hanger. The enclosure cushion can be used as a flat floor mat. The floor mat and pillow bag are made of flexible cloth, and the inside is filled with elastic materials such as sponge, which can provide all-round protection for babies in the enclosure cushion and increase the comfort of the pillow bag as a pillow. Setting the toy hanger in the enclosure cushion can increase the fun of the baby in the enclosure cushion and develop the baby's intelligence.

Figure 1:
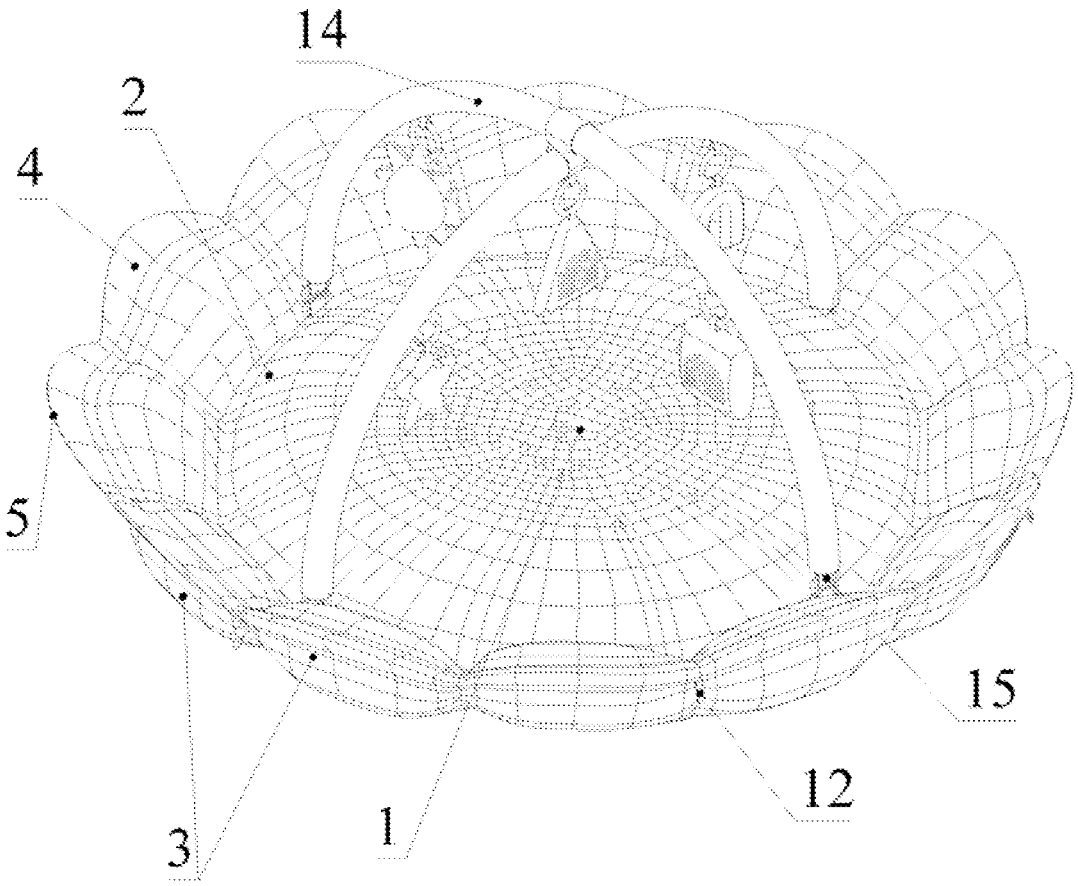
FIG. 1 is a perspective view of a multifunctional enclosure cushion in the enclosed state (toy hanger installed) of the present application.
Figure 2:
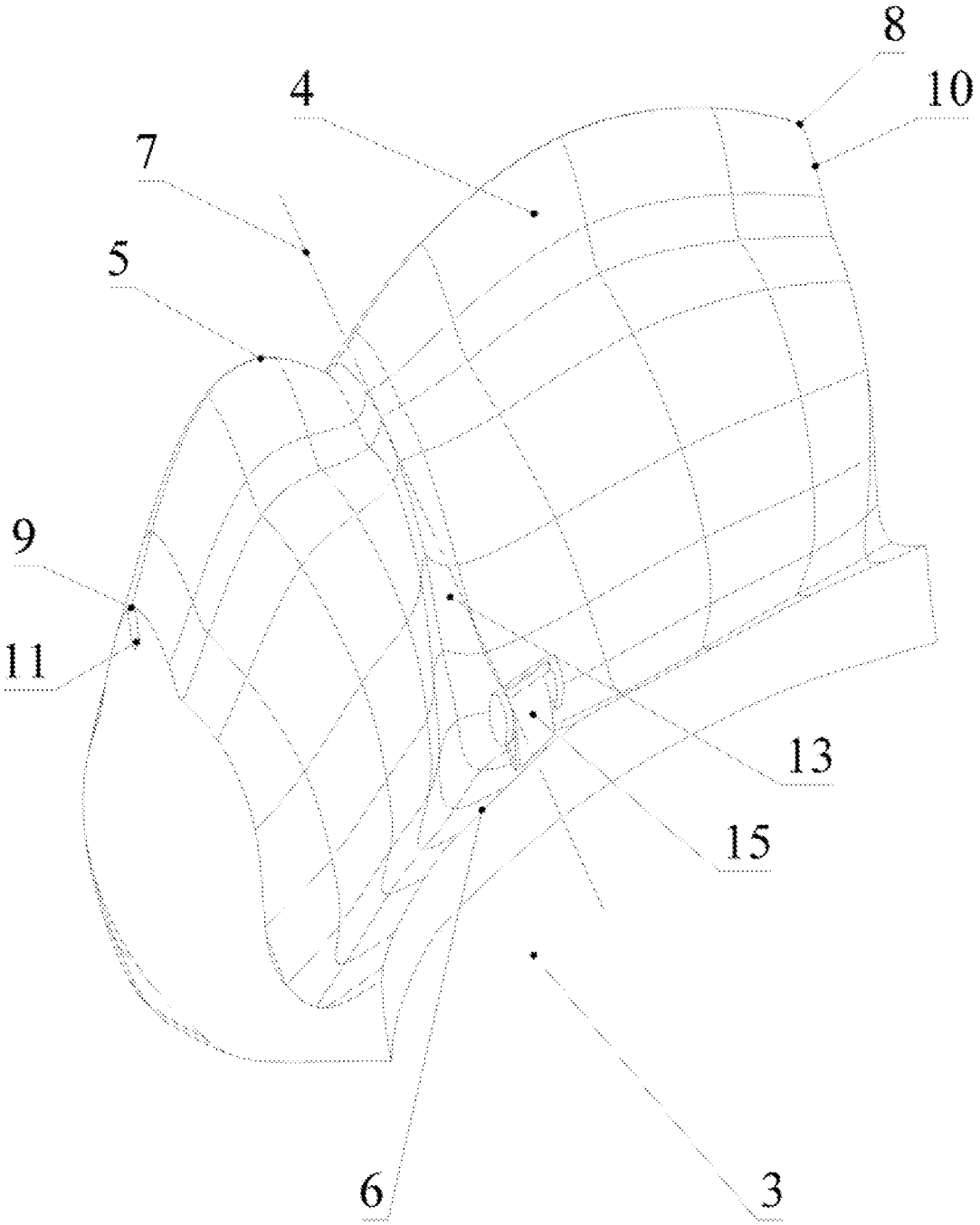
FIG. 2 is a schematic diagram of a multifunctional enclosure pillow bag according to the present application.
Figure 3:
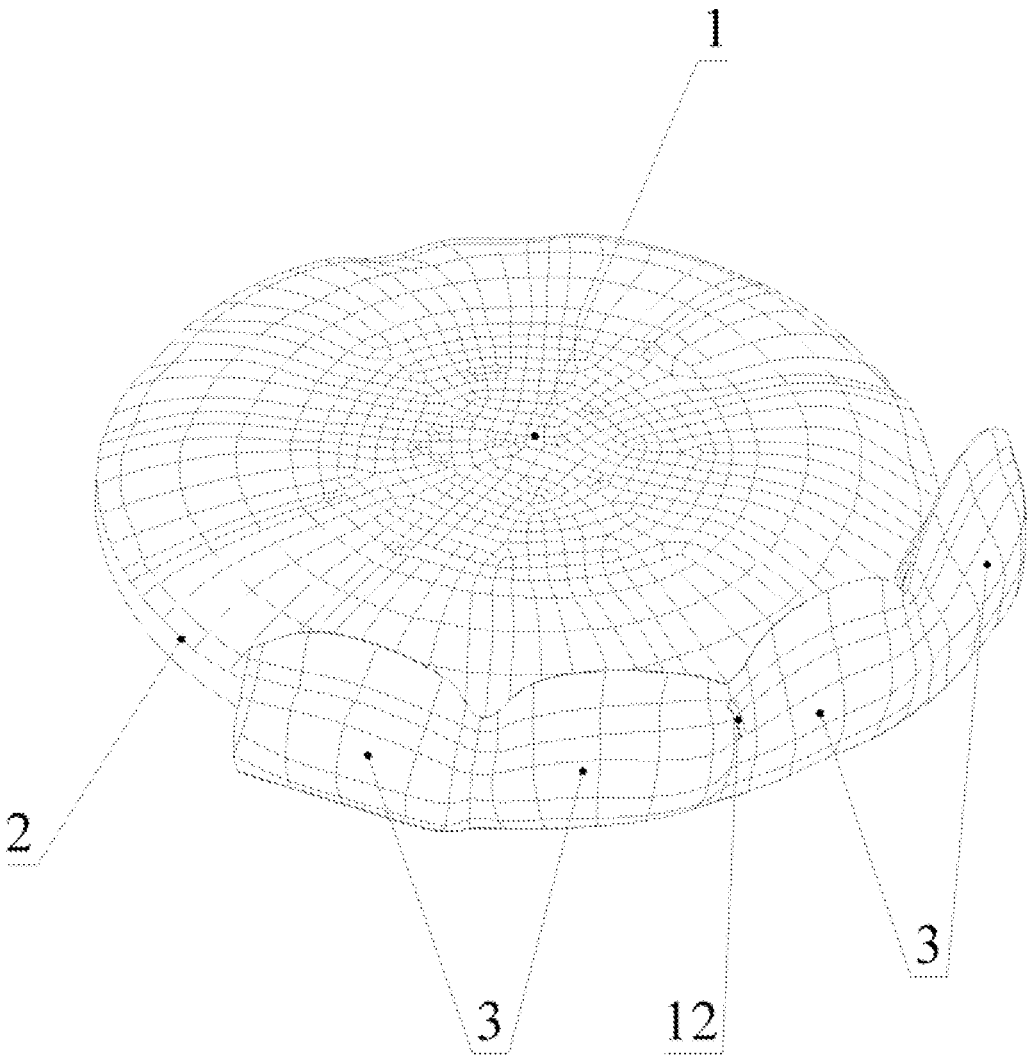
FIG. 3 is a schematic diagram of a multifunctional enclosure cushion with two pillow bags (toy hanger removed)

In the figures: 1. Floor mat; 2. Outer edge; 3. Pillow bag; 4. Envelope; 5. Outer edge; 6. Inner edge; 7. Central axis; 8. Peripheral end point; 9. Peripheral end point; 10. Wire harness; 11. Wire harness; 12. Pull ring; 13. Concave shape; 14. Toy hanger; 15. Hinge.

DESCRIPTION OF EMBODIMENTS

In Embodiment 1, as shown in FIGS. 1-10, a multifunctional enclosure cushion includes a floor mat 1, wherein the floor mat 1 comprises an outer edge 2, the outer edge 2 is connected with a pillow bag 3, and the pillow bag 3 has a parabolic cross section and comprises peripheral end points 8 and 9; and an envelope 4, wherein the envelope 4 has an outer edge 5, an inner edge 6 and a central axis 7; the inner edge 6 is connected with the outer edge 2 of the floor mat 1, the pillow bag 3 is formed with a concave shape 14 at the position of the central axis 7; the peripheral end points 8, 9 are respectively fixed with wire harnesses 10 and 11, and the wire harnesses 10 ad 11 extend oppositely along the outer edge 5 of the envelope 4 and meet at the central axis 7 to form a pull ring 12; when the pull ring is pulled, the two wire harnesses 10 and 11 drive the peripheral end points 8 and 9 of the pillow bag 3 to gather in the direction of the central axis 7, and at this time, the pillow bag 3 simultaneously turns up along the outer edge 2 of the floor mat 1 to form an enclosure.

When it is necessary to form a complete enclosure for the floor mat 1, a plurality of pillow bags 3 are arranged around the floor mat 1. The pull ring 12 is pulled, and since the wire harness 10 and the wire harness 11 are respectively fixed with the peripheral end point 8 and the peripheral end point 9, the opposite movement of the wire harness 10 and the wire harness 11 drives the peripheral end point 8 and the peripheral end point 9 to move toward each other, and gather toward the central axis 7, thereby tightening the pillow bags 3. Because of the elasticity of the filling material inside the pillow bags 3, the tightened pillow bags 3 will turn up and down along the outer edge 2 of the floor mat 1. Because the enclosure cushion is placed on the ground, there is no room for the pillow bags 3 to turn down, and only the pillow bags 3 can be turned up one by one. A plurality of pillow bags 3 around the floor mat 1 turn up to finally form a complete enclosure for the floor mat 1. By adjusting the size of the pull ring 12, the desired enclosure height and width can be obtained, and then toy hangers can be installed according to the actual use requirements, so as to increase the fun of babies in the enclosure cushion.

As a preferred embodiment of the present application, as shown in FIGS. 1-10, the outer edge 2 and the pillow bags 3, and the adjacent pillow bags 3 are all connected by sewing, so that the connection structure is firm and reliable, and it is not easy to break; sponges are filled in the floor mat 1 and the pillow bag 3, which can make use of the characteristics of sponges to form a soft and elastic buffer layer between the baby and the ground, so as to prevent the baby from accidentally falling or bumping when climbing and rolling in the enclosure cushion, and to form all-round protection for the baby; when that shape of the floor mat 1 is round or nearly round, the lateral width of the pillow bag 3 decrease towards the center of the floor mat, and the pillow bag 3 can turn up along the outer edge 2 of the floor mat 1 without obstacles; two adjacent pillow bags 3 are connected by sewing, so that no gap is formed between the two pillow bags 3, and babies are prevented from climbing out of the floor mat from the gap between the two adjacent pillow bags 3; the wire harness 10 and the wire harness 11 are fixedly connected with the peripheral end point 8 and the peripheral end point 9 by sewing, the connection structure is firm and reliable, and the wire harness 10 and the wire harness 11 are not easy to break from the peripheral end point 8 and the peripheral end point 9 due to repeated pulling of the wire harness 10 and the wire harness 11, thereby avoiding the failure of the enclosure function; the floor mat 1 is detachably connected with the toy hanger 15 through the hinge 16, which increases the fun of the baby in the enclosure cushion and is beneficial to the development of the baby's intelligence, and also liberates the attention of adults; the toy hanger 15 is made of sponge and bent into an arch shape, which can use the elasticity of the sponge to pull the floor mat 1, so as to avoid the folding and deformation of the floor mat 1 caused by the baby's activities, thus reducing the activity space in the enclosure.

Figure 4:
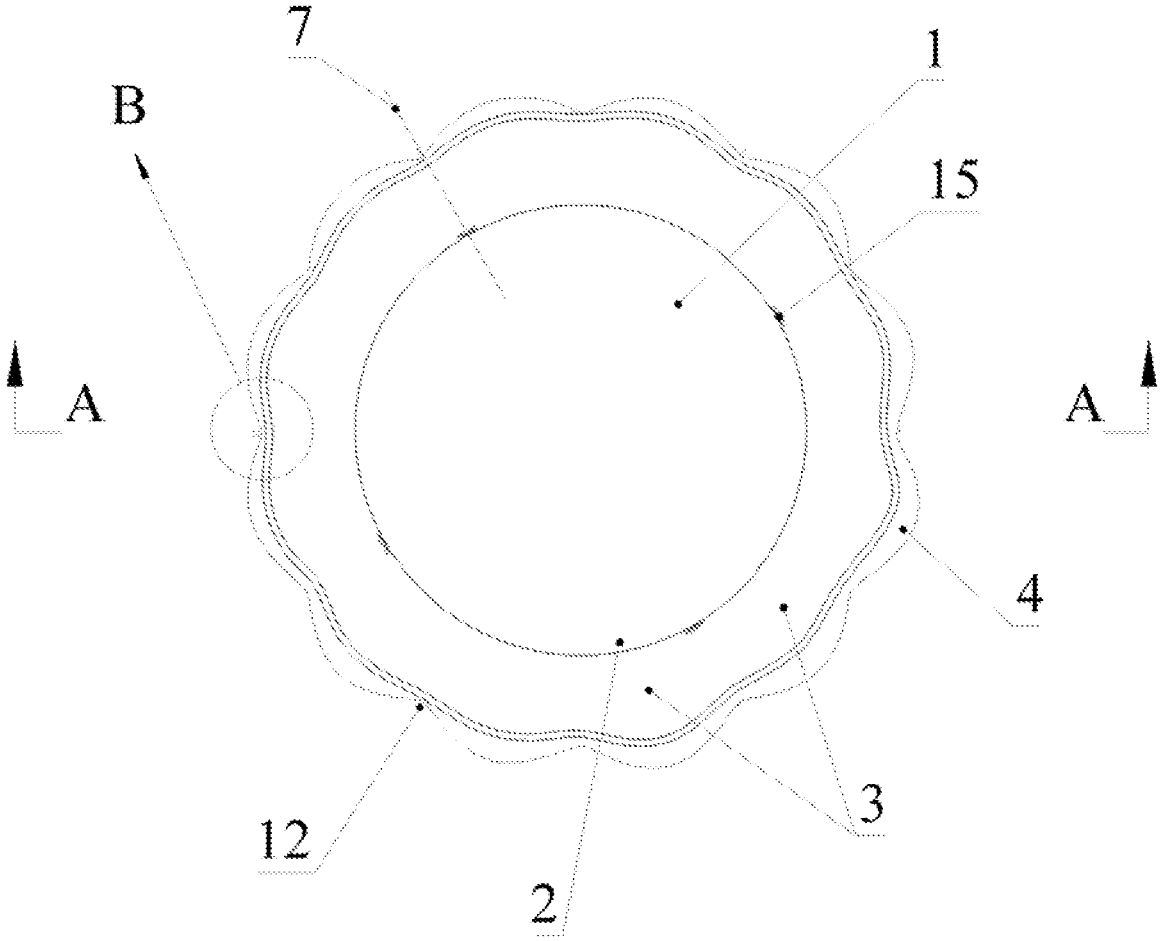
FIG. 4 is a plan view of a multifunctional enclosure cushion in the unfolded state (toy hanger removed) of the present application.
Figure 5:
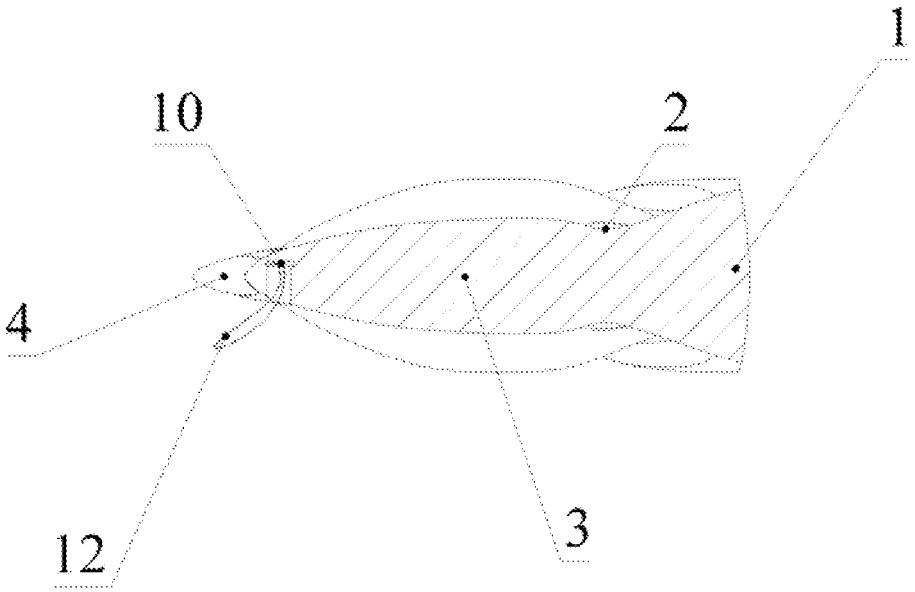
FIG. 5 is a sectional view taken along A-A, b in FIG. 4.
Figure 6:
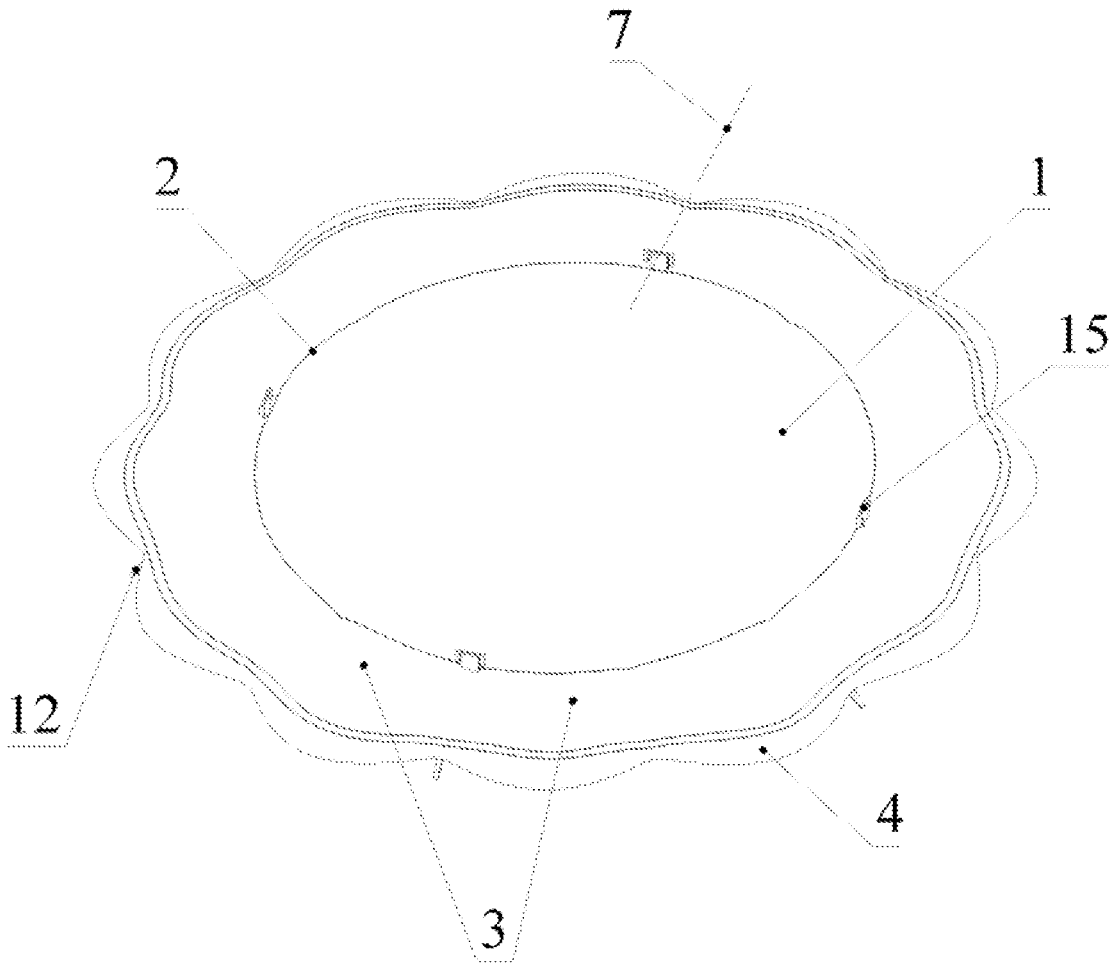
FIG. 6 is a perspective view of a multifunctional enclosure cushion in the unfolded state (toy hanger removed) of the present application.

In Embodiment 2, as shown in FIGS. 4 and 6, when the enclosure cushion according to Embodiment 1 needs to be used as a flat floor mat, it is only necessary to adjust the pull ring 12, reset the upturned pillow bag 3, and disassemble the toy hanger 15 to make the enclosure cushion a flat floor mat.

Figure 7:
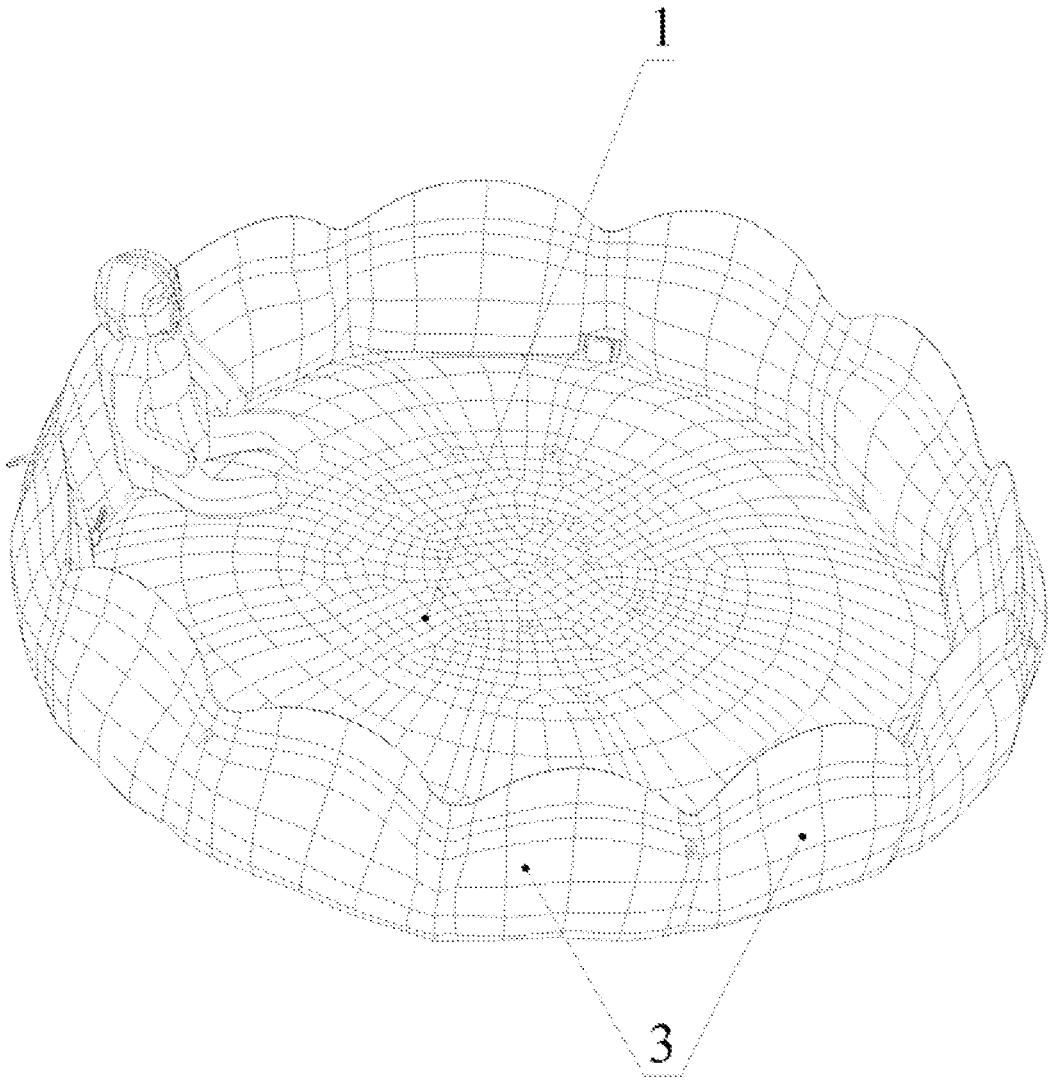
FIG. 7 is a schematic diagram of a multifunctional enclosure pillow bag as a backrest of the present application.

In Embodiment 3, according to the enclosure cushion of Example 1, as shown in FIG. 7, the upturned pillow bag 3 can be used as the baby's back in the enclosure, and the surface of the pillow bag 3 with a parabolic cross section is designed to fit the baby's lumbar spine. The baby can use the pillow bag 3 in the enclosure to train the sitting posture and cultivate the sense of balance when sitting, while the floor mat 1 and pillow bag 3 filled with elastic and soft sponge can provide all-round protection for the baby, without worrying that the baby will be injured after falling.

Figure 8:
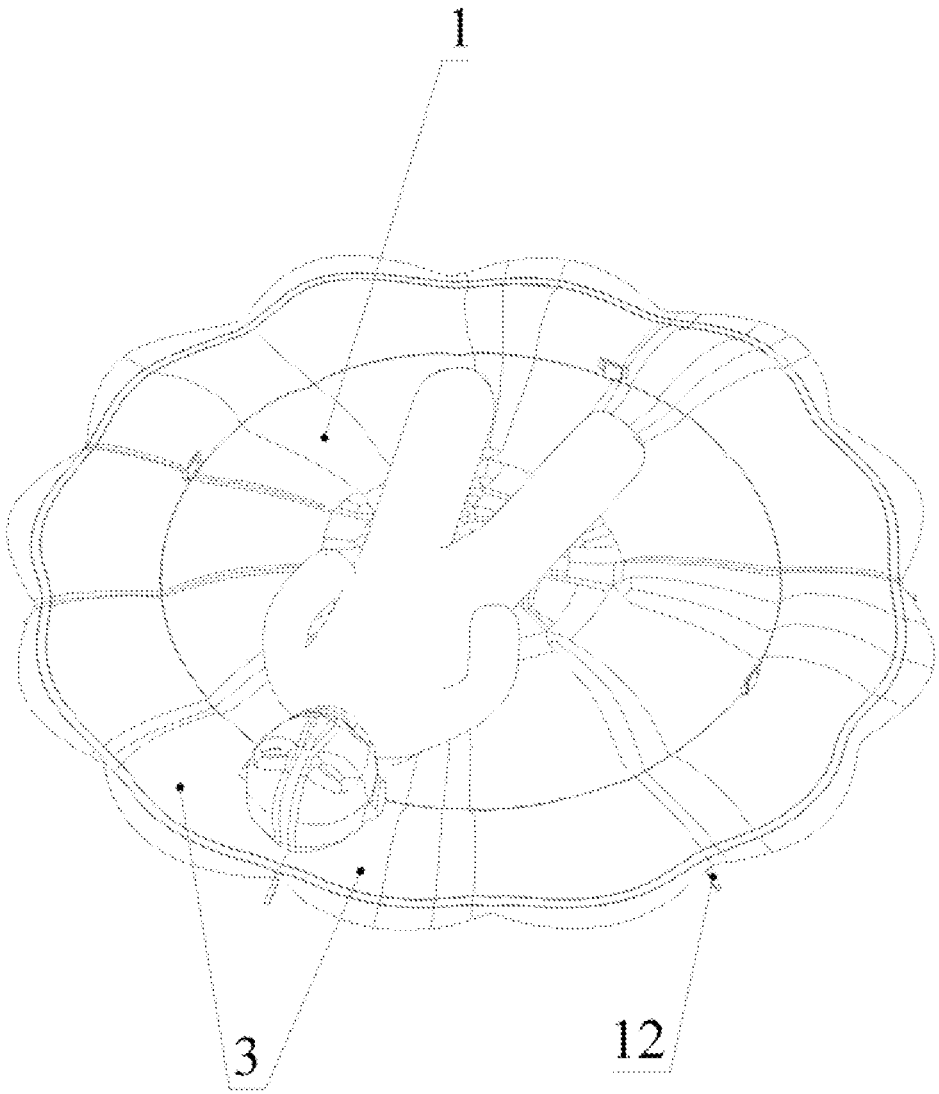
FIG. 8 is a schematic diagram of a multifunctional enclosure cushion as a pillow according to the present application.

In Embodiment 4, according to the enclosure cushion of Embodiment 1, as shown in FIG. 8, the enclosure cushion is designed to be used as a floor for larger children or adults. The pillow bag 3 is used as a pillow for children or adults. The concave 14 formed along the central axis 7 of the pillow bag 3 is designed to accommodate the head, and the arc-shaped bulges on both sides of the concave are designed to fix the head and neck to avoid stiff neck. The upturned height of the pillow bag 3 can also be selected by adjusting the size of the pull ring 12 to adapt to the sleeping habits of different adults or children. Sponge or other elastic materials, such as latex or gel, are filled in the pillow bag 3. It can also greatly increase the comfort of the pillow bag 3 as a pillow. The floor mat 1 can be extended or widened by zippers or hook and loop to adapt to the size of the torso, and the sponge filled in the floor mat 1 can also increase the comfort of the human body.

Figure 9:
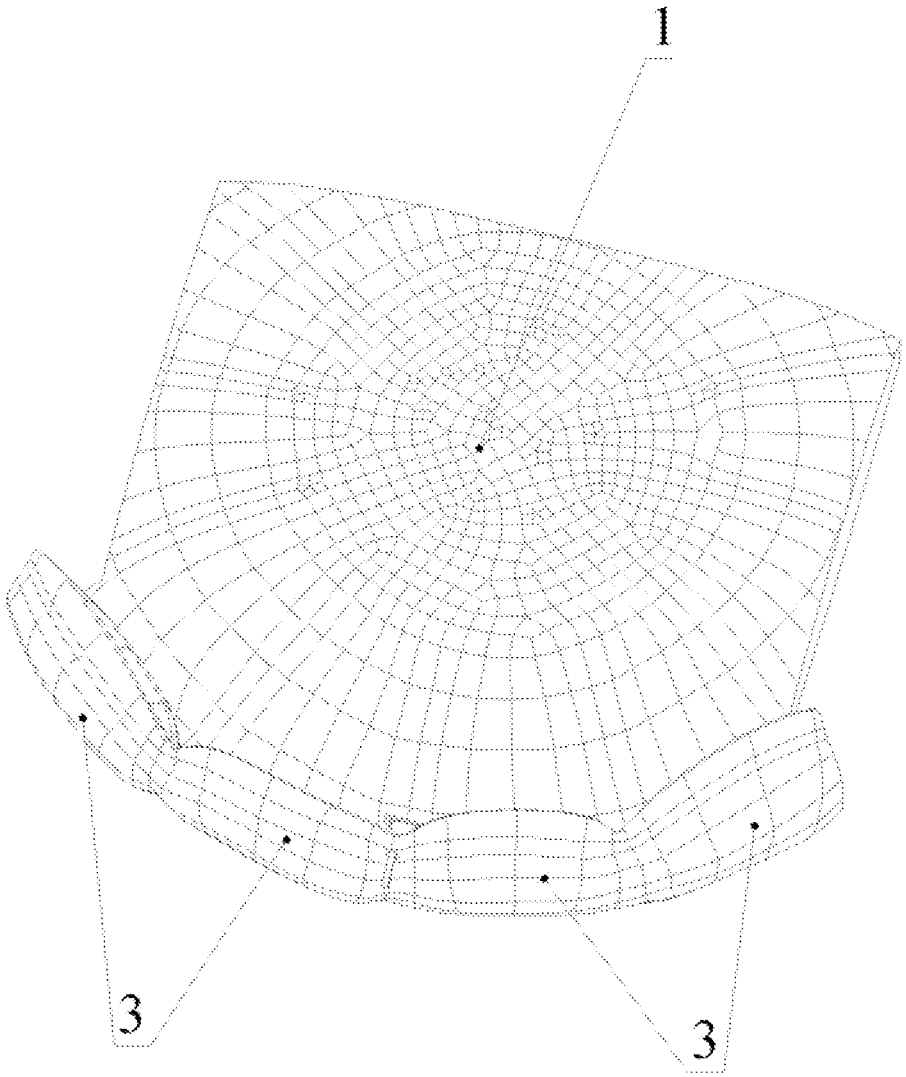
FIG. 9 and FIG. 10 are schematic diagrams of a multifunctional enclosure cushion with other shapes.
Figure 10:
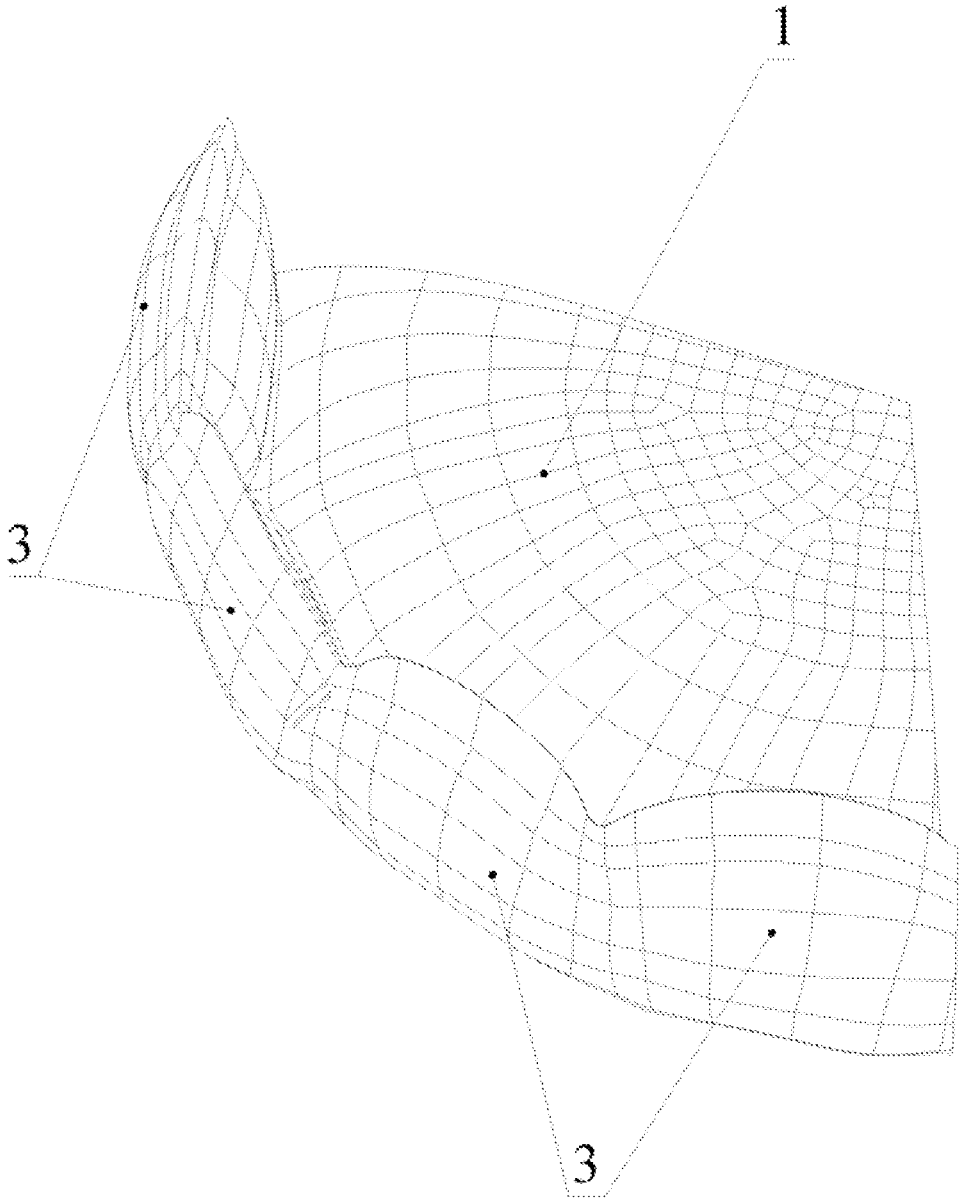

In Embodiment 5, according to the enclosure cushion of Embodiment 1, as shown in FIGS. 9 and 10, the enclosure cushion is designed to be suitable for an aisle or a corner in the home, and the floor mat 1 will be designed to be rectangular or fan-shaped. At this time, the number of pillow bags 3 is designed to form an enclosure for the floor mat 1 together with other wall surfaces or limiting surfaces, and the floor mat 1 can be extended by hook and loop or zipper to increase the activity area of babies in the enclosure.

In Embodiment 6, according to the enclosure cushion of Embodiment 1, as shown in FIG. 1, the enclosure cushion is designed to be used as a baby cradle. The toy hanger 15 detachably connected with the floor mat 1 can be used as a hanger of a baby cradle, and the enclosure cushion which forms a complete enclosure state can be used as a carrier for babies. One or more toy racks 15 are arranged on the mat 1, and the enclosure cushion which forms a complete enclosure state is hung to a high place through the toy racks 15, and the enclosure cushion can be used as a baby cradle by gently shaking it.

In Embodiment 7, according to the enclosure cushion according to Embodiment 1, latex is filled inside the floor pad and the pillow bag.

In Embodiment 8, according to the enclosure cushion according to Embodiment 1, gel is filled inside the floor pad and the pillow bag.

In Embodiment 9, according to the enclosure cushion according to Embodiment 1, the floor mat and the pillow bag are connected by hook and loop.

In Embodiment 10, according to the enclosure cushion according to Embodiment 1, the floor mat and the pillow bag are connected by a zipper.

In Embodiment 11, according to the enclosure cushion of Embodiment 1, the pillow bag and the adjacent pillow bag are connected by hook and loop.

In Embodiment 12, according to the enclosure cushion of Embodiment 1, the pillow bag and the adjacent pillow bag are connected by zipper.

In Embodiment 13, according to the enclosure cushion according to Embodiment 1, the hinge is a snap button.

In Embodiment 14, according to the enclosure cushion according to Embodiment 1, the hinge is a spring buckle.

The above description is only the specific implementation of this application, but the scope of protection of this application is not limited to this. Any person familiar with this technical field can easily think of changes or substitutions within the technical scope disclosed in this application, which should be covered by the scope of protection of this application. Without conflict, the embodiments of the present application and the features in the embodiments can be combined with each other. Therefore, any modification, equivalent substitution, improvement, etc. made within the spirit and principle of the present application should be included in the scope of protection of the present application.

What is claimed is:

1. A multifunctional enclosure cushion, comprising a floor mat, wherein the floor mat comprises an outer edge, the outer edge is connected with a pillow bag, and the pillow bag has a parabolic cross section and comprises peripheral end points; and an envelope, wherein the envelope has an outer edge, an inner edge and a central axis; the inner edge is connected with the outer edge of the floor mat, the pillow bag is formed with a concave shape at the position of the central axis; the peripheral end points are respectively fixed with wire harnesses, and the wire harnesses extend oppositely along the outer edge of the envelope and meet at the central axis to form a pull ring; wherein the pull ring is configured such that when the pull ring is pulled, the two wire harnesses drive the peripheral end points of the pillow bag to gather in the direction of the central axis, and at this time, the pillow bag simultaneously turns up along the outer edge of the floor mat to form an enclosure; a toy hanger and a hinge;

wherein the toy hanger is made of sponge and bent into an arch shape, the hinge is a snap fastener or spring clip, and the toy hanger is detachably and movably connected to the floor mat via the hinge; and when the pillow bag is flipped up to form an enclosed state, the toy hanger is configured to suspend the multifunctional enclosed pad at a higher position for use as an infant cradle or baby carrier.

2. The multifunctional enclosure cushion according to claim 1, wherein the floor mat is round, and the pillow bag is arranged around the circumference of the floor mat.

3. The multifunctional enclosure cushion according to claim 1, wherein the floor mat and the pillow bag are made of flexible cloth and filled with elastic materials.

4. The multifunctional enclosure cushion according to claim 1, wherein the outer edge is connected with the pillow bag by sewing, and the pillow bag is connected with the adjacent pillow bag by sewing.

5. The multifunctional enclosure cushion according to claim 1, wherein the lateral width of the pillow bag decreases towards the center of the floor mat.

6. The multifunctional enclosure cushion according to claim 1, wherein the wire harnesses are fixedly connected with the peripheral end points by sewing.

* * * * *